US005436640A

United States Patent [19]

Reeves

[11] Patent Number: 5,436,640

[45] Date of Patent: Jul. 25, 1995

[54] VIDEO GAME AND SIMULATOR JOYSTICK CONTROLLER WITH GEARED POTENTIOMETER ACTUATION

[75] Inventor: David W. Reeves, Aloha, Oreg.

[73] Assignee: Thrustmaster, Inc., Tigard, Oreg.

[21] Appl. No.: 347,587

[22] Filed: Nov. 30, 1994

Related U.S. Application Data

[63] Continuation of Ser. No. 145,982, Oct. 29, 1993, abandoned.

[51] Int. Cl.[6] ..... G09G 3/02

[52] U.S. Cl. ..... 345/161; 273/438

[58] Field of Search ..... 345/161; 341/20; 365/709.09; 273/148 B, 438; 338/68; 74/471 XY; 200/6 R

[56] References Cited

U.S. PATENT DOCUMENTS

| | | | |
|---|---|---|---|
| 2,762,234 | 9/1956 | Dodd | 74/471 XY |
| 3,870,161 | 3/1975 | Cording | 74/471 XY |
| 4,093,953 | 6/1978 | Hammons et al. | 74/471 XY |
| 4,489,304 | 12/1984 | Hayes | 74/471 XY |
| 4,520,355 | 5/1985 | Mitch | 345/161 |
| 4,587,510 | 5/1986 | Kim | 273/148 BX |
| 5,230,059 | 7/1993 | Nielsen et al. | 345/161 X |

*Primary Examiner*—Ulysses Weldon
*Attorney, Agent, or Firm*—Marger, Johnson, McCollom & Stolowitz

[57] ABSTRACT

A joystick controller for a video simulation system having a geared potentiometer actuation mechanism. The joystick controller comprises a base, a handle mounted on an actuation shaft, and first and second gimbals pivotally mounted on the base by pivot members for rotational movement about respective axes. The joystick shaft is coupled to the first and second gimbals so that the gimbals rotate about their corresponding axes responsive to movement of the joystick handle. Each gimbal has a corresponding potentiometer for sensing the rotational movement thereof. The first gimbal has a first gear connected thereto for rotational movement therewith. The corresponding potentiometer is mounted on the base opposite the first gear and a second gear is connected to the stem of the potentiometer such that the second gear is in tooth engagement with the first gear. A similar gearing configuration is used to couple the second gimbal to the corresponding potentiometer. A cable is connected to the to the two potentiometers to allow their settings read by the video simulation system when the cable is connected thereto.

13 Claims, 2 Drawing Sheets

VIDEO GAME AND SIMULATOR JOYSTICK CONTROLLER WITH GEARED POTENTIOMETER ACTUATION

This is a continuation of application Ser. No. 08/145,982, filed Oct. 29, 1993, now abandoned.

BACKGROUND OF THE INVENTION

This invention relates generally to video game or video simulator controllers and more particularly to actuation mechanisms within joystick controllers.

Joystick controllers are used as an input device to computers running a video game/simulator software to control the directionality of a simulated system, such as an aircraft. The joystick requires two dimensional range of motion, i.e., both X and Y axes, to provide maximum directional control. In a personal computer running aircraft simulator software, for example, movement of the joystick along the X axis of the joystick changes the horizontal direction of the aircraft, while movement of the joystick along the Y axis of the joystick controls the vertical direction of the aircraft.

The position of the joystick may assume a multiplicity of unique coordinates, the exact number of unique coordinates being limited only by the resolution of the position sensors or transducers within the controller. Moreover, the user can swing the joystick between any of these positions in a sudden and unpredictable manner in response to a sudden change in the simulation conditions. This dynamic behavior of the joystick is used by the simulator to respond to the changed conditions.

In contrast, a throttle controller, for example, requires only one dimensional range of motion. The throttle controller is positionable along a single axis. The static position of the throttle controller along the axis determines the fuel setting input to an aircraft simulator. Typically, the throttle setting is set at a predetermined level and remains there for a given period of time. Although this level can be changed from time to time, e.g., take-off and landing, the rate and frequency of the change is substantially less than that of a joystick.

There are two primary means for detecting the joystick position. The first is an optical technique, the second is a mechanical technique. The present invention is an improved mechanical technique, thus, the optical technique is not discussed herein. The prior art mechanical technique uses two orthogonally-positioned potentiometers to detect the joystick position in two dimensions. Each potentiometer is dedicated to a particular joystick axis. Essentially, the translational movement of the joystick along an axis turns the stem of the corresponding potentiometer dedicated to that axis. The potentiometer setting is thus directly proportional to the coordinate of the joystick along the corresponding axis.

In prior art joysticks, the coupling between the joystick and the potentiometer stem is a direct drive connection. In the direct drive coupled joysticks, the potentiometer stem is directly connected to a corresponding gimbal. The stem of the potentiometer thus acts as the pivot point for the corresponding gimbal. Each gimbal rotates in one direction about the axis of the potentiometer stem and is resiliently held in a center of neutral position by a pair of springs mounted at opposite ends of the gimbal. As the gimbal is rotated by moving the joystick in one dimension it turns the corresponding potentiometer stem.

The direct drive connection subjects the potentiometer to a lateral force that lowers the reliability of the potentiometer. In using the joystick, a user commonly applies a downward force on the handle, especially in simulation programs that require sudden forceful movements of the joystick handle, such as in air combat flight simulators. In the direct drive joysticks, the downward force is applied directly to the stem of the potentiometer as a lateral force. This lateral force eventually causes the potentiometer to fail. Examples of direct connection joysticks, such as those described above, are found in some of the joystick products by Thrustmaster, Inc., of Tigard, Oreg., and CH, Inc., Vista, Calif.

The springs used to return the gimbal to the neutral position also exert a lateral force on the potentiometer stem that further lowers the reliability of the potentiometer. Each gimbal has two springs mounted thereon at opposite ends. Each spring has a center coil section, and two end portions. Each end portion has an orthogonal finger at the distal end thereof extending away from the coil portion. In the relaxed state the two fingers are spaced apart and substantially collinear.

In use, the coil of one of the springs is mounted on the potentiometer stem. One finger is connected to the gimbal and the other is connected to a mounting bracket holding the potentiometer. As the gimbal rotates so that the end portions cross, a force is generated that attempts to push the coil portion away from the end portions. This force is coupled to the potentiometer stem, as a lateral force, because the coil is mounted on the stem. A force in the opposite lateral direction is generated on the stem if the gimbal rotates in the opposite direction so that the end portions of the spring move away from each other. In addition to creating this lateral force, rotating the spring in this direction tends to permanently deform the spring because the spring is being expanded rather than compressed. To counteract this deformation, the second identical spring is used on the opposite side of the gimbal. The second spring is rotated by 180 degrees so that the second spring is compressed when the first spring is expanded and vice versa.

Accordingly, a need remains for an actuation and transducer mechanism for a joystick that is operable in two dimensions without exerting a lateral force on the potentiometer stem.

SUMMARY OF THE INVENTION

It is, therefore, an object of the invention to reduce the amount of lateral force applied to the potentiometers in a two-dimensional joystick.

Another object is to simplify the mechanism for centering the joystick.

The invention is an improved joystick controller for a video simulation system, which includes a base and a handle and two potentiometers positioned orthogonally on the base. Two overlapping gimbals are pivotally mounted on the base in an orthogonal relationship. One such gimbal is pivotally mounted on the base by means of a pivot member journaled in a mounting bracket on both sides of the gimbal for movement in a first pivotal direction corresponding to movement of the joystick along a first joystick axis. The other gimbal is pivotally mounted on the base by means of a pivot member journaled in another mounting bracket on both sides of the gimbal for movement of the joystick along a second joystick axis. In accordance with the invention, each gimbal is rotationally coupled to a rotatable stem of a corresponding potentiometer by means of a gearing system. The gearing system effectively eliminates the application of lateral forces generated by the off-axis movement of the joystick to the stem of the potentiometer. Such forces are restricted to the pivot members and brackets. The potentiometer settings are then transmitted to the video game/simulator by means of a cable coupled between the joystick and a game board connected to the personal computer on which the video game/simulator is running.

In the preferred embodiment, the gearing system includes a first gear connected to the corresponding gimbal for rotational movement therewith and a second gear mounted on the opposing mounting bracket, in tooth engagement with the first gear, connected to the stem of the corresponding potentiometer. Thus, movement of the gimbal produces a corresponding rotational movement of the corresponding potentiometer stem, thereby encoding the position of the joystick along the corresponding joystick axis. The ratio of the first gear to the second gear is preferably a 1:1 ratio, but a gear ratio of up to 5:1 can be used to employ the full range of potentiometer.

An improved biasing means is also included in the joystick. The biasing means urges the joystick to a neutral position, typically substantially vertical. According to one aspect of the invention, there is one biasing means coupled to each gimbal. The biasing means preferably comprises a single spring mounted on a mounting bracket for connecting the corresponding gimbal resiliently to one side of the base. The spring includes a coil portion, a first end portion, and a second end portion. The first and second end portions of the spring are substantially parallel to each other and to the base, and further extend in opposite sides from the coil portion. First and second stops are fixedly mounted on the mounting bracket and extend over the first end portion of the spring, respectively. First and second studs are fixedly mounted to the gimbal and extend over the first and second end portions of the spring, respectively. The studs engage the corresponding end portion of the spring when the gimbal rotates responsive to movement of the handle. The stops prevent the opposite end portion of the spring from rotating when the gimbal rotates. The rotation of only one end of the spring compresses the spring and thereby produces a force opposing the rotational movement of the gimbal. Thus, when the handle is released the opposing force returns the gimbal, and therefore the handle, to the neutral position.

One advantage of the invention is the increased longevity of the springs used in the joystick. Another advantage is increased lifetime of the potentiometers.

The foregoing and other objects, features and advantages of the invention will become more readily apparent from the following detailed description of a preferred embodiment of the invention which proceeds with reference to the accompanying drawings.

DETAILED DESCRIPTION

Figure 1:
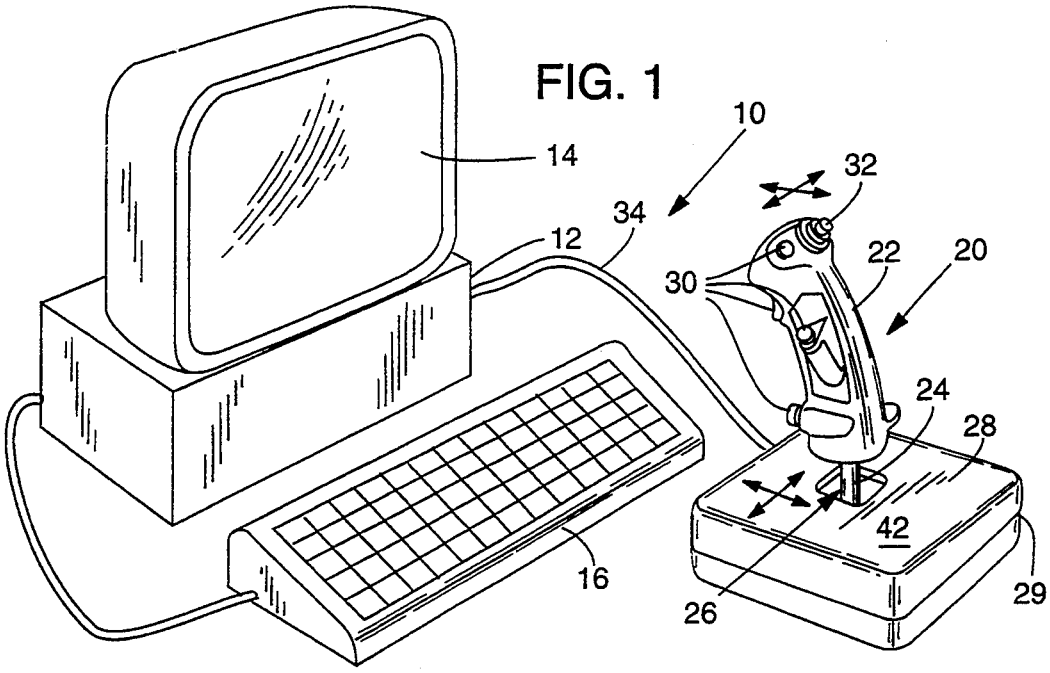
FIG. 1 is a perspective view of a video game/simulator system including a personal computer and a joystick controller.

Referring to FIG. 1, a video simulation system is shown generally at 10. The video simulation system includes a personal computer 12 and a joystick controller 20. The personal computer includes a monitor 14 and a keyboard 16. The monitor 14 is connected to the personal computer 12 by means of a video input port on the personal computer (not visible). The keyboard 16 is connected to the personal computer 12 at a keyboard input port (not visible). The personal computer 12 further includes an internal microprocessor on which a video simulation computer program is operable. The video simulation program generates graphic images to be displayed on the video monitor 14 responsive to inputs from the joystick controller 20.

The joystick controller 20 includes a handle 22 mounted on an actuation shaft 24 that protrudes upward through an opening 26 of a base 28. The handle 22 further includes a plurality of discreet switches 30 as well as a hat switch controller 32 that is operable by a user's thumb. In the preferred embodiment the joystick handle includes four discreet switches as shown in FIG. 1. The joystick handle has a full 360 degree range of pivotal movement around a centered vertical axis or neutral position. The handle movement, however, can be decomposed into movement along two axes, X and Y. The joystick has only a limited range of angular movement along the X and Y axes, e.g., 60 degrees or ±30 degrees from the neutral position. The joystick 20 is connected to the personal computer 12 via a cable 34 connected to a game input port (not visible) on the personal computer. The cable 34 includes a plurality of conductors each of which is connected to one discreet switch, a hat switch output, or a joystick potentiometer.

Figure 2:
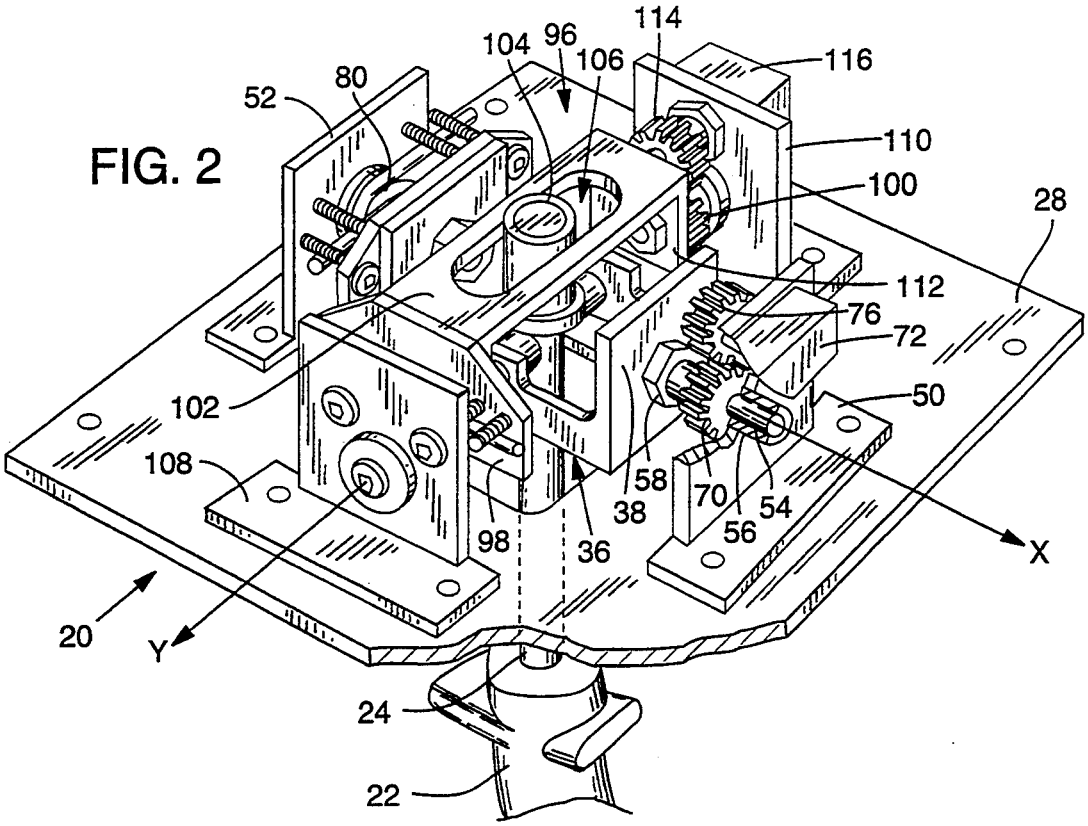
FIG. 2 is a bottom perspective view of the joystick controller with the housing removed.
Figure 3:
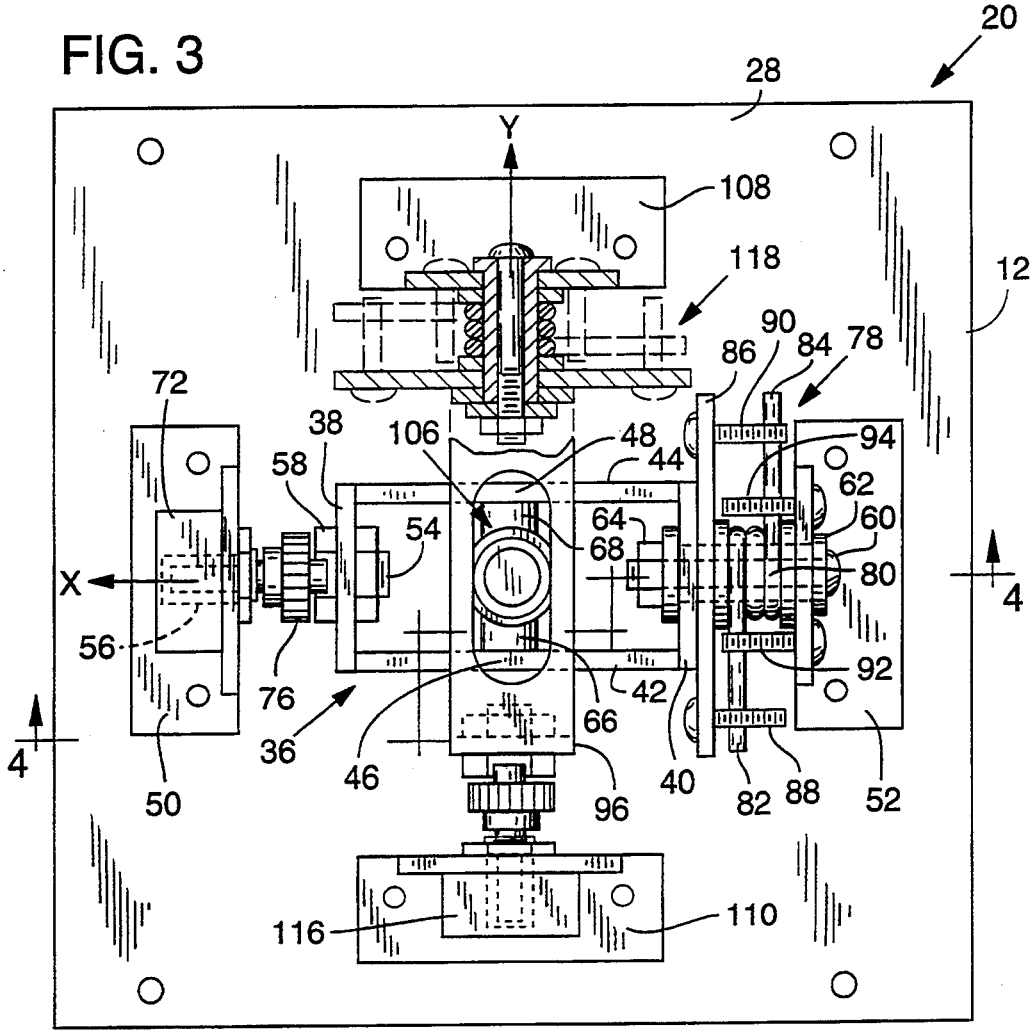
FIG. 3 is a bottom plan view of the joystick controller of FIG. 2.
Figure 4:
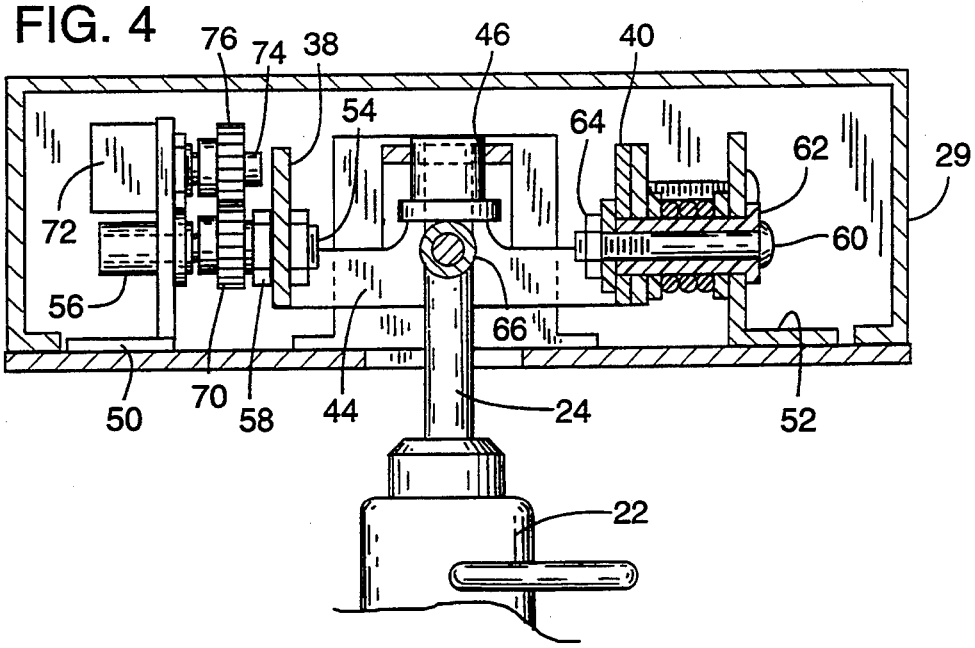
FIG. 4 is a cross-sectional view of the joystick controller taken along lines 4—4 in FIG. 3.

Referring now to FIGS. 2–4, a description of the joystick controller position control and sensing mechanism contained in a housing 29 is described hereinbelow. The joystick controller includes a first C-shaped gimbal 36 mounted on the base 28 for pivotal movement about a first axis X. The first gimbal includes a first mounting plate 38, a second mounting plate 40, and cross-members 42 and 44 connected therebetween. The cross-members 42 and 44 include tabs 46 and 48, respectively, midway therealong and perpendicular thereto. The tabs are used to connect the shaft 24 to the first gimbal 36 as described further below.

The first gimbal 36 is pivotally mounted to the base 28 for pivotal movement about the X axis by means of L-shaped mounting brackets 50 and 52 juxtaposed to first and second mounting plates 38, 40 of the gimbal 36, respectively. Mounting plate 38 is connected to mounting bracket 50 by means of a pivot member 54 connected to mounting bracket 38 for rotational movement therewith. The pivot member 54 is journaled in a pivot mount 56 in the mounting bracket 50. The pivot member 54, as shown in FIGS. 2–4, is a machine screw that is connected to mounting plate 38 by means of a nut 58. The distal end of the pivot member 54, in the case of a screw, has the threads at the distal end lathed off to provide a smooth surface inside the pivot mount 56. A midportion of the pivot member 54 is knurled to hold a gear in place when mounted thereon, as described further below. Alternatively, the pivot member can simply be a pin or similar means formed integrally with mounting plate 38.

Mounting plate 40 is pivotally connected to mounting bracket 52 by means of a pivot member 60 that in the preferred embodiment of the invention is a machine screw. The pivot member 60 is journaled in a sleeve 62 that is received in opposing pivot mounts in the mounting plate 40 and the mounting bracket 52. In the preferred embodiment, the sleeve 62 is formed of a hard plastic. A nut 64 retains the pivot member 60 in the sleeve.

The shaft 24 of the joystick handle is connected to the first gimbal 36 by means of lateral protrusions 66 and 68 formed on opposing sides of the shaft along the Y axis. The protrusions 66 and 68 extend at right angles away from the shaft 24 to abut respective gimbal cross-members 42 and 44, respectively. The shaft is then connected to the cross-members by means of a pin (not visible) extending through a channel formed co-linear to the Y axis through the cross-members 42 and 44, and protrusions 66 and 68. The pin is then secured to the cross-members by means of a nut or pin. Thus connected, movement of the handle 22 along the Y axis imparts a rotational movement of the first gimbal about the X axis.

Mounted on the knurled portion of pivot member 54 is a first spur gear 70. Thus, the first gear 70 rotates with the first gimbal responsive to movement of the handle along the Y axis because the pivot member 54 is fixedly connected to the mounting plate 38. A potentiometer 72 is mounted on the mounting bracket 50 above the journaled pivot mount 56. The potentiometer has a stem 74 that is capable of rotational movement. Rotational movement of the stem 74 changes the internal resistance of the potentiometer 72 in a manner that is known in the art. The potentiometer 72 is mounted on the bracket 50 such that the stem 74 extends over the first gear 70.

A second gear 76 is mounted on the stem 74 such that the teeth of gear 76 mesh with those of gear 70. The second gear 76 can be either mounted directly above the first gear, as shown, or mounted on one side. If mounted on one side, the potentiometer would also have to be repositioned accordingly so that the potentiometer stem maintains a spaced apart parallel relation to the gimbal pivot member 54. Mounting the second gear on the side may also further reduce the coupling of any force between the first and second gears. Gear 76, thus connected in tooth engagement with gear 70, rotates responsive to movement of gear 70. The rotational movement of gear 76 rotates stem 74 of the potentiometer thus changing the internal setting of the potentiometer. Therefore, movement of the handle along the Y axis can be transduced by the resistance setting of the potentiometer 72.

Although not shown individually, it is known to one of ordinary skill in the art that one or more conductors of cable 34 are used to transmit an electrical signal proportional to the internal resistance setting of the potentiometer 72 to the personal computer. However, for sake of simplicity the individual conductors are not shown apart from cable 34.

The joystick controller 20 further includes improved biasing means for urging the joystick handle to a neutral or upright position. The neutral position of the joystick is shown in FIG. 1 and corresponds to a shaft position that is normal to the base 28. The biasing means includes a spring, shown generally at 78 in FIG. 3, mounted on the pivot member 60 between the mounting plate 40 and the mounting bracket 52. The spring 78 includes a coil portion 80 and first and second end portions 82 and 84, respectively. The end portions extend tangentially in opposite directions away from the coil portion and are substantially coplanar. Connected to the mounting plate 40 is an extended mounting plate 86 that extends beyond the mounting plate 40.

A first stud 88 is mounted on the mounting plate 86 and extends over the first end portion 82 of the spring. Similarly, a second stud 90 is mounted on the mounting plate 86 opposite the first stud 88 and extends over the second end portion of the spring 84. In the preferred embodiment, the studs are machine screws that are mounted to the mounting plate 86 by threads formed therein. Mounted on the mounting bracket 52 between the coil portion 80 and the first stud 88 is a first stop 92 that extends over the first end portion 82 of the spring. Fixedly mounted to the mounting bracket 52 on the opposite side of the coil 80 between the second stud and the coil portion is a second stop 94 extending over the second end portion 84 of the spring. The studs and stops, in the preferred embodiment, are substantially coplanar and abut their respective end portions of the spring in the neutral position.

In operation, the spring 78 urges the handle to the bias position by means of a compressive force exerted against one of the studs. For example, if the joystick handle is moved along the Y axis such that the first stud 88 rotates towards the first end portion of the spring, the stud will engage the first end of the spring thereby causing the second end of the spring to rotate in the same direction until the second end portion engages the second stop 94. Once the second end portion engages the stop 94, thereafter the spring will wind and thereby generate a compressive force opposing the rotational movement of the handle. The spring exerts a force in the opposing direction when the handle is moved along the Y axis in the opposite direction.

The joystick controller further includes a second C-shaped gimbal 96 pivotally mounted to the base for pivotal movement about the Y axis. The second gimbal is mounted on the base in a substantially orthogonal relationship to the first gimbal. The gimbal 96 includes a first mounting plate 98, a second mounting plate 100 and a cross-member 102 connected therebetween. The cross-member has a longitudinal opening formed therein for receiving an end portion 104 of the shaft 24. The width of the opening, as measured along the X axis, is slightly larger than the diameter of the end portion 104. The end portion 104 is preferably made of a smooth plastic material to allow the end portion to slide along the opening with minimal friction as the handle moves along the Y axis. The length of the opening 106 is determined by the maximum angular movement of the joystick handle about the X axis. The end portion 104 extends slightly above the opening 106 so that the end portion remains in contact with the gimbal 96 throughout the full range of motion of the handle.

The second gimbal is mounted to the base 28 by means of L-shaped mounting brackets 108 and 110. The mounting plate 100 is mounted to the mounting bracket 110 in a manner substantially identical to how mounting plate 38 is mounted to mounting bracket 50. Thus, the manner of pivotally mounting the mounting plate 100 to mounting bracket 110 is not further described. Similarly, mounting plate 98 is pivotally mounted to mounting bracket 108 in a manner substantially identical to the mounting of mounting plate 40 to mounting bracket 52 and thus is not repeated herein.

As with gimbal 36, gimbal 96 has a gear 112 fixedly mounted to mounting plate 100 that is in tooth engagement with a second gear 114 mounted on a stem of a second potentiometer 116 mounted on mounting bracket 110. The manner in which the gears are connected is substantially identical to that described above with reference to gear 70 and 76. Also, the second gimbal 96 has connected thereto a spring 118 for urging the handle into the neutral position. The spring 118 is mounted on the pivot member connected between the mounting plate 98 and the corresponding mounting bracket 108 in a manner substantially identical to the spring 78. Furthermore, the same stud and stop configuration is used to generate the compressive force to oppose the rotational movement of the handle about the X axis.

The precise ratio of the gears is chosen according to the range of motion of the handle along the axis and the range of motion of the potentiometer. In the preferred embodiment, the full range of motion of the handle is approximately 60 degrees. The potentiometer has approximately 270 degree range of motion. Thus, the corresponding gear ratio is approximately 5:1 (i.e., 270:60≅5:1). This ideal gear ratio would produce the maximum resolution. To maintain backwards compatibility with direct drive systems, however, a 1:1 gear ratio can be used.

The gear drive system herein described decouples the angular motion of the gimbals from the stem of the corresponding potentiometer such that little to no lateral force is exerted on the stem of the potentiometer. This increases the longevity of the potentiometer substantially over the direct drive configurations known in the prior art. Also, the spring biasing means described herein only causes the spring to be wound rather than unwound in the prior art systems. By only winding, the springs return to their normal position without being permanently deformed. This further increases the life span of the springs and helps to maintain the handle in the neutral position throughout the life of the joystick controller. The spring mechanism also eliminates two springs completely from the prior art controllers.

Having described and illustrated the principles of the invention in a preferred embodiment thereof, it should be apparent that the invention can be modified in arrangement and detail without departing from such principles. I claim all modifications and variation coming within the spirit and scope of the following claims.

I claim:

1. A joystick controller for a video simulation system comprising:

a base;

a handle pivotally mounted on the base for rotational movement in a first direction about a first axis and a second direction about a second axis, normal to the first axis;

a first potentiometer mounted on the base and having a stem coupled to the handle for rotational movement about an axis parallel to the first axis;

a second potentiometer mounted on the base and having a stem coupled to the handle for rotational movement about an axis parallel to the second axis;

means for transmitting the first and second potentiometer settings to the video simulation system;

a first torsion spring operatively coupled between the handle and the base for imparting a compressive force to the handle responsive to forward or backward movement of the handle along the first direction; and a second torsion spring operatively coupled between the handle and the base for imparting a compressive force to the handle responsive to forward or backward movement of the handle along the second direction.

2. A joystick controller according to claim 1 wherein the first and second torsion springs each include a coil portion, and first and second end portions extending tangentially in opposite directions from the coil portion.

3. A joystick controller according to claim 2 including:

a first gimbal pivotally coupling the handle to the base for pivotal movement about the first axis;

a first stop fixedly mounted on the base and extending over the first end portion of the first torsion spring;

a second stop fixedly mounted on the base and extending over the second end portion of the first torsion spring;

a first stud fixedly mounted on the first gimbal and extending over the first end portion of the first torsion spring; and a second stud fixedly mounted on the first gimbal and extending over the second end portion of the first torsion spring.

4. A joystick controller according to claim 3 including a second gimbal pivotally coupling the handle to the base for pivotal movement about the second axis;

a third stop fixedly mounted on the base and extending over the first end portion of the second torsion spring;

a fourth stop fixedly mounted on the base and extending over the second end portion of the second torsion spring;

a third stud fixedly mounted on the second gimbal and extending over the first end portion of the second torsion spring; and a fourth stud fixedly mounted on the second gimbal and extending over the second end portion of the second torsion spring.

5. A joystick controller according to claim 2 including:

a first gimbal;

first and second coaxial pivot members for pivotally mounting the first gimbal to the base for pivotal movement about the first axis;

means for coupling the first gimbal to the handle such that the first gimbal pivots about the first axis responsive to movement of the handle in the first direction;

a second gimbal;

third and fourth coaxial pivot members for pivotally mounting the second gimbal to the base for pivotal movement about the second axis; and means for coupling the second gimbal to the handle such that the second gimbal pivots about the second axis responsive to movement of the handle in the second direction.

6. A joystick controller according to claim 1 including:

a second gimbal pivotally coupling the handle to the base for pivotal movement about the second axis;

a third stop fixedly mounted on the base and extending over the first end portion of the second torsion spring;

a fourth stop fixedly mounted on the base and extending over the second end portion of the second torsion spring;

a third stud fixedly mounted on the second gimbal and extending over the first end portion of the second torsion spring; and a fourth stud fixedly mounted on the second gimbal and extending over the second end portion of the second torsion spring.

7. A joystick controller for a video simulation system comprising:

a base;

a handle mounted on an actuation shaft;

a first gimbal;

means including a pivot member for pivotally mounting the first gimbal to the base for pivotal movement about a first axis;

means for coupling the first gimbal to the shaft such that the first gimbal pivots about the first axis responsive to movement of the handle in a first direction;

a second gimbal;

means including a pivot member for pivotally mounting the second gimbal to the base for pivotal movement about a second axis;

means for coupling the second gimbal to the handle such that the second gimbal pivots about the second axis responsive to movement of the handle in a second direction;

a first potentiometer mounted on the base and having a stem coupled to the first gimbal for rotational movement responsive to rotational movement of the first gimbal about the first axis;

a second potentiometer having a stem coupled to the second gimbal for rotational movement responsive to rotational movement of the second gimbal about the second axis;

means for transmitting the first and second potentiometer settings to the video simulation system;

a first torsion spring coupled to the first gimbal for urging the first gimbal into a neutral position by a compressive force when the handle is moved forward or backward along the first direction; and a second torsion spring coupled to the second gimbal for urging the second gimbal into the neutral position by a compressive force when the handle is moved forward or backward along the second direction, each torsion spring including a coil portion, and first and second end portions extending tangentially in opposite directions from the coil portion, wherein the coil of the first torsion spring is compressed when the handle is moved along the first direction and the coil of the second torsion spring is compressed when the handle is moved along the second direction.

8. A joystick controller according to claim 7 further including:

a first stop fixedly mounted on the base and extending over the first end portion of the first torsion spring;

a second stop fixedly mounted on the base and extending over the second end portion of the first torsion spring;

a first stud fixedly mounted on the first gimbal and extending over the first end portion of the first torsion spring; and a second stud fixedly mounted on the first gimbal and extending over the second end portion of the first torsion spring.

9. A method of biasing a joystick for a video simulation system into a neutral position, the joystick having a base, a handle mounted on an actuation shaft, a first gimbal, means for coupling the first gimbal to the shaft such that the first gimbal pivots about a first axis responsive to movement of the handle in a first direction, a first potentiometer operatively coupled to the first gimbal for indicating rotational movement thereof, a second gimbal, means for coupling the second gimbal to the handle such that the second gimbal pivots about a second axis, orthogonal to the first axis, responsive to movement of the handle in a second direction, a second potentiometer operatively coupled to the second gimbal for indicating rotational movement thereof, and means for transmitting the potentiometer indications to the video simulation system, the method comprising:

pivotally mounting the first gimbal on the base;

pivotally mounting the second gimbal on the base;

coupling a first torsion spring between the first gimbal and the base to bias the handle into the neutral position, the first torsion spring including a coil portion, and first and second end portions extending tangentially in opposite directions from the coil portion;

coupling a second torsion spring between the second gimbal and the base to bias the handle into the neutral position, the second torsion spring including a coil portion, and first and second end portions extending tangentially in opposite directions from the coil portion;

generating a first compressive force responsive to movement of the handle along the first direction, the first compressive force resisting forward or backward movement of the handle along the first direction; and generating a second compressive force responsive to movement of the handle along the second direction, the second compressive force resisting forward or backward movement of the handle along the second direction.

10. A method of biasing a joystick for a video simulation system into a neutral position according to claim 9 wherein the step of generating a first compressive force responsive to movement of the handle along the first direction includes:

rotating the first end portion of the first torsion spring; and stopping the second end portion of the first torsion spring from rotating.

11. A method of biasing a joystick for a video simulation system into a neutral position according to claim 9 wherein the step of generating a first compressive force responsive to movement of the handle along the first direction includes:

rotating the second end portion of the first torsion spring; and stopping the first end portion of the first torsion spring from rotating.

12. A method of biasing a joystick for a video simulation system into a neutral position according to claim 9 wherein the step of pivotally mounting the first gimbal on the base includes:

connecting first and second mounting brackets to the base on opposite sides of the first gimbal;

coupling a first pivot member between the first mounting bracket and a respective side of the first gimbal; and coupling a second pivot member between the second mounting bracket and a respective side of the first gimbal.

13. A method of biasing a joystick for a video simulation system into a neutral position according to claim 12 wherein the step of coupling a first torsion spring between the first gimbal and the base to bias the handle into the neutral position includes slidably mounting the first torsion spring on the first pivot member.

* * * * *